US008353248B2

(12) United States Patent
Kurahashi et al.

(10) Patent No.: US 8,353,248 B2
(45) Date of Patent: Jan. 15, 2013

(54) TRACK-GUIDED VEHICLE WHEEL TRACK

(75) Inventors: Hiroki Kurahashi, Mihara (JP); Nobuyuki Fujio, Mihara (JP); Hiroyuki Kono, Hiroshima (JP); Yukihide Yanobu, Hiroshima (JP); Akihisa Kawauchi, Hiroshima (JP); Kousuke Katahira, Kawasaki (JP)

(73) Assignee: Mitsubishi Heavy Industires, Ltd, Tokyo (JP)

( * ) Notice: Subject to any disclaimer, the term of this patent is extended or adjusted under 35 U.S.C. 154(b) by 0 days.

(21) Appl. No.: 13/260,427

(22) PCT Filed: Jul. 1, 2009

(86) PCT No.: PCT/JP2009/062063

§ 371 (c)(1),
(2), (4) Date: Oct. 17, 2011

(87) PCT Pub. No.: WO2010/109684

PCT Pub. Date: Sep. 30, 2010

(65) Prior Publication Data

US 2012/0031298 A1 Feb. 9, 2012

(30) Foreign Application Priority Data

Mar. 25, 2009 (JP) ..... 2009-073953

(51) Int. Cl.
*B61F 1/00* (2006.01)

(52) U.S. Cl. ..... 105/215.2; 104/247

(58) Field of Classification Search ..... 105/72.2, 105/215.1, 215.2; 410/67; 104/243–249
See application file for complete search history.

(56) References Cited

U.S. PATENT DOCUMENTS 3,077,165 A * 2/1963 Vittorelli ..... 104/247
3,921,466 A * 11/1975 Allsup, Jr. ..... 74/110
4,089,272 A * 5/1978 Schmitz ..... 104/247
4,105,086 A * 8/1978 Ishii et al. ..... 180/410

(Continued)

FOREIGN PATENT DOCUMENTS

JP 48-86214 A 11/1973

(Continued)

OTHER PUBLICATIONS

Office Action corresponding to JP 2009-073953, dated Jan. 20, 2012.

(Continued)

*Primary Examiner* — Jason C Smith
(74) *Attorney, Agent, or Firm* — Lowe Hauptman Ham & Berner LLP

(57) ABSTRACT

In a track-guided vehicle wheel truck, a guide frame can be turned relative to a steering axle of a running wheel. A support shaft is adjustably provided on the guide frame. A receiving member is provided projecting toward the vehicle end side. A link lever capable of interlocking the turning of the guide frame and the steering of the running wheel, is provided along the vehicle front and rear direction. A center-side end part of the link lever is rotatably mounted to the receiving member. A vehicle end-side end part of the link lever is rotatably mounted to a connecting rod that enables the steering of the running wheel. A long hole extending in the vehicle front and rear direction, is provided in an intermediate part of the link lever. The long hole and the support shaft are rotatably engaged with each other at a given position.

4 Claims, 8 Drawing Sheets

U.S. PATENT DOCUMENTS

| | | | | |
|---|---|---|---|---|
| 4,183,304 | A * | 1/1980 | Forster | 104/247 |
| 4,223,611 | A * | 9/1980 | Dawson et al. | 104/247 |
| 4,265,180 | A * | 5/1981 | Uozumi | 104/247 |
| 4,274,338 | A * | 6/1981 | Uozumi | 105/144 |
| 4,299,172 | A * | 11/1981 | Dawson | 104/247 |
| 4,454,819 | A * | 6/1984 | Cuylits et al. | 104/245 |
| 6,029,579 | A * | 2/2000 | Andre et al. | 105/72.2 |
| 6,477,963 | B1 * | 11/2002 | Weule et al. | 104/243 |
| 8,074,577 | B2 * | 12/2011 | Morichika et al. | 104/139 |
| 8,161,889 | B2 * | 4/2012 | Morichika et al. | 105/72.2 |
| 2008/0083345 | A1 * | 4/2008 | Morita et al. | 104/106 |
| 2009/0259352 | A1 * | 10/2009 | Morichika et al. | 701/19 |
| 2009/0288575 | A1 * | 11/2009 | Morichika et al. | 104/139 |
| 2010/0036553 | A1 * | 2/2010 | Morichika et al. | 701/19 |
| 2010/0100267 | A1 * | 4/2010 | Morichika et al. | 701/23 |
| 2011/0265683 | A1 * | 11/2011 | Kurahashi et al. | 105/215.2 |
| 2011/0271868 | A1 * | 11/2011 | Kurahashi et al. | 105/141 |
| 2012/0017800 | A1 * | 1/2012 | Kurahashi et al. | 105/182.1 |
| 2012/0031298 | A1 * | 2/2012 | Kurahashi et al. | 105/215.2 |

FOREIGN PATENT DOCUMENTS

| | | | |
|---|---|---|---|
| JP | 50150004 | U1 | 12/1975 |
| JP | 51000608 | U1 | 1/1976 |
| JP | 53-30407 | B2 | 8/1978 |
| JP | 61006061 | A | 1/1986 |
| JP | 61006061 | A1 | 1/1986 |
| JP | 1-27492 | Y2 | 8/1989 |
| JP | 2006-306334 | A | 11/2006 |
| JP | 2008-068829 | A | 3/2008 |

OTHER PUBLICATIONS

International Search Report for PCT/JP2009/062063 mailed Sep. 1, 2009.

Notice of Allowance for JP2009-073953 mailed Apr. 13, 2012.

U.S. Notice of Allowance dated Oct. 16, 2012 issued in U.S. Appl. No. 13/143,841.

* cited by examiner

TRACK-GUIDED VEHICLE WHEEL TRACK

RELATED APPLICATIONS

The present application is a National Phase of International Application Number PCT/JP2009/062063, filed Jul. 1, 2009 and claims priority from, Japanese Application Number 2009-073953, filed Mar. 25, 2009.

TECHNICAL FIELD

The present invention relates to a track-guided vehicle wheel truck (bogie) which runs along a track.

BACKGROUND ART

In general, a track-guided vehicle (hereinafter referred to as a "vehicle"), such as a subway car and a new transportation system vehicle, runs along a track while being guided by a guide rail arranged along the track. In a conventional vehicle, a running wheel which is a rubber tire or the like, is arranged facing in a fixed direction at all times relative to a guide wheel guided by the guide rail. Therefore, the direction of the running wheel is changed only by following the guide rail. However, when the vehicle moves into a curved guide rail, a large guide wheel working force directed toward the guide rail, is applied to the guide wheel due to a force generated by the running wheel traveling straight or due to a centrifugal force acting on the vehicle. The guide wheel and the guide rail are thereby brought into contact with each other at a large pressure. As a result, there occurs a problem in that wear and deterioration are easily caused on the guide wheel and the guide rail.

To solve the problem, a cornering force on the running wheel opposing to the guide wheel working force, is increased, to thereby reduce the contact pressure of the guide wheel and the guide rail. As a method of increasing the cornering force, a steering mechanism for steering the running wheel is provided in the wheel truck of the vehicle, and the running wheel is steered by the steering mechanism so as to increase a slip angle (a steering angle) when the vehicle moves into the curved guide rail.

A wheel truck including such a steering mechanism is disclosed in Patent Document 1. In Patent Document 1, two running wheels on the identical axis are rotatably provided by a kingpin, are connected to each other by an axle that extends in the vehicle width direction, and also can be interlocked with each other by a tie rod arranged along the vehicle width direction. On the other hand, a guide wheel guided by a guide rail is mounted to a guide frame, and the guide frame can be turned around the center position between the pair of running wheels relative to the axle. Furthermore, a steering rod for steerably connecting one of the pair of running wheels to the guide frame, is arranged along the vehicle width direction. One end of the steering rod is mounted to a steering arm for steering one of the pair of running wheels, and the other end of the steering rod is mounted to the guide frame so as to be movable in the vehicle front and rear direction. In addition, an actuator, which is extensible and retractable in the vehicle front and rear direction, is provided on the guide frame, and the end on the guide frame side of the steering rod, is mounted to the actuator. By the movement of the other end of the steering rod along with the operation of the actuator, the distance between the other end of the steering rod and the turning center of the guide frame (or the axle), is changed relative to the distance between one end on the running wheel side of the steering rod and the axle, so that the steering rod adopts a posture tilting relative to the axle. As a result, the displacement of the steering aim changes with the movement of the steering rod, and therefore the slip angle of the running wheel steered by the steering arm is changed.

Citation List

Patent Document

Patent Document 1: U.S. Pat. No. 6,477,963

SUMMARY OF INVENTION

Technical Problem

However, in the wheel truck in Patent Document 1, the posture of the steering rod arranged in the vehicle width direction, is changed by the operation of the actuator in the vehicle front and rear direction, to thereby adjust the slip angle of the running wheel steered when the guide frame is turned. Therefore, the relationship among the operation of the actuator, the posture change of the steering rod, and the change in the slip angle of the running wheel, is complicated, so that the structure and control thereof is also complicated. Accordingly, it is difficult to control the operation of the actuator so as to slightly change the slip angle of the running wheel. For example, it is not possible to finely adjust the slip angle of the running wheel in response to a disturbance such as crosswind in order to allow the vehicle to stably run during straight running.

Furthermore, in the wheel truck in Patent Document 1, a fail-safe function assuming the breakdown of the actuator is not provided. Therefore, if the actuator breaks with the running wheel tilting relative to the guide frame, the running wheel in a straight running state is misaligned. In this case, there occurs a problem that the running wheel runs in a side slip state or the like.

The present invention has been made in view of the aforementioned circumstances, and it is an object of the invention to provide a track-guided vehicle wheel truck in which, while simplifying the structure, the wear and deterioration of a guide wheel and a guide rail is prevented, when an actuator is used, the slip angle of a running wheel can be finely adjusted and the occurrence of trouble in association with the breakdown of the actuator can be prevented with the actuator being simply controlled, and also, the running stability is ensured.

Solution to Problem

To achieve the above object, a track-guided vehicle wheel truck according to the present invention includes: a pair of running wheels respectively connected to the two ends of a steering axle by a kingpin; a guide wheel guided along a guide provided on a running track; and a guide frame to which the guide wheel is mounted, the guide frame capable of being turned relative to the steering axle, the track-guided vehicle wheel truck comprising: a tie rod arranged along a vehicle width direction on a center side of a vehicle front and rear direction relative to the steering axle, and capable of interlocking the pair of running wheels with each other; a connecting rod arranged on a vehicle end side of the vehicle front and rear direction relative to the steering axle, and capable of steering one of the pair of running wheels; a first steering arm arranged along the vehicle front and rear direction, and mounted to one of the kingpins of the pair of running wheels; a second steering arm arranged along the vehicle front and rear direction, and mounted to the other of the kingpins of the pair of running wheels; a support shaft provided on the guide frame such that its position can be adjusted in the vehicle front and rear direction; and a link lever arranged along the vehicle front and rear direction; wherein the two end parts of the tie rod are rotatably mounted respectively to center-side end parts of the first steering arm and the second steering arm; wherein the two end parts of the connecting rod are rotatably mounted respectively to a vehicle end-side end part of the first steering arm and a vehicle end-side end part of the link lever; wherein a center-side end part of the link lever is rotatably mounted to a receiving member provided projecting toward the vehicle end side in a center part of the vehicle width direction of the steering axle; wherein a long hole is provided in an intermediate part of the link lever so as to extend in the vehicle front and rear direction; and wherein the long hole and the support shaft are rotatably engaged with each other at a given position.

In the track-guided vehicle wheel truck according to the present invention, a restoration mechanism capable of restoring the support shaft to an original position after moving the support shaft is provided in the guide frame, and the support shaft is movable by an actuator provided in the guide frame.

In the track-guided vehicle wheel truck according to the present invention, the support shaft is movable in the vehicle width direction by an actuator.

In the track-guided vehicle wheel truck according to the present invention, the guide wheel is supported by a leaf spring provided in the guide frame, detecting means for detecting a displacement of the leaf spring is provided, and control means for controlling the actuator corresponding to the displacement of the leaf spring detected by the detecting means is provided.

Advantageous Effects of Invention

The following effects can be obtained according to the present invention. A track-guided vehicle wheel truck according to the present invention includes: a pair of running wheels respectively connected to the two ends of a steering axle by a kingpin; a guide wheel guided along a guide provided on a running track; and a guide frame to which the guide wheel is mounted, the guide frame capable of being turned relative to the steering axle, the track-guided vehicle wheel truck comprising: a tie rod arranged along a vehicle width direction on a center side of a vehicle front and rear direction relative to the steering axle, and capable of interlocking the pair of running wheels with each other; a connecting rod arranged on a vehicle end side of the vehicle front and rear direction relative to the steering axle, and capable of steering one of the pair of running wheels; a first steering arm arranged along the vehicle front and rear direction, and mounted to one of the kingpins of the pair of running wheels; a second steering arm arranged along the vehicle front and rear direction, and mounted to the other of the kingpins of the pair of running wheels; a support shaft provided on the guide frame such that its position can be adjusted in the vehicle front and rear direction; and a link lever arranged along the vehicle front and rear direction; wherein the two end parts of the tie rod are rotatably mounted respectively to center-side end parts of the first steering arm and the second steering arm; wherein the two end parts of the connecting rod are rotatably mounted respectively to a vehicle end-side end part of the first steering arm and a vehicle end-side end part of the link lever; wherein a center-side end part of the link lever is rotatably mounted to a receiving member provided projecting toward the vehicle end side in a center part of the vehicle width direction of the steering axle; wherein a long hole is provided in an intermediate part of the link lever so as to extend in the vehicle front and rear direction; and wherein the long hole and the support shaft are rotatably engaged with each other at a given position.

Accordingly, the support shaft of the guide frame and the intermediate part of the link lever, are engaged with each other, and the center-side end part of the link lever is mounted to the receiving member on the vehicle end side relative to the steering axle. Therefore, when the vehicle moves into a curved guide rail, and the guide wheel and the guide frame are turned along the curved guide rail, the link lever rotates around the center-side end part. At this time, the vehicle end-side end part of the link lever rotates in a larger circle than the intermediate part of the link lever corresponding to the ratio of the distance between the vehicle end-side end part of the link lever and the center-side end part, to the distance between the support shaft in the intermediate part of the link lever and the center-side end part. Therefore, the vehicle end-side end part of the link lever is moved more than the guide frame in the same direction as the turning of the guide frame. The connecting rod is thereby moved, so that the first steering arm is also moved. As a result, one of the pair of running wheels is steered to assume a slip angle in an oversteer state. Furthermore, the tie rod is moved when one of the pair of running wheels is steered, so that the second steering arm is moved. As a result, the other of the pair of running wheels is steered to assume a slip angle in an oversteer state. Accordingly, a cornering force on the pair of running wheels is increased, a guide wheel working force directed toward the guide rail from the guide wheel, is decreased, and the contact pressure of the guide wheel and the guide rail is decreased.

Since the support shaft is provided on the guide frame such that its position can be adjusted in the vehicle front and rear direction, the engagement position of the support shaft and the long hole can be changed in the intermediate part of the link lever. Therefore, the ratio of the distance between the vehicle end-side end part of the link lever and the center-side end part, to the distance between the support shaft in the intermediate part of the link lever and the center-side end part can be changed, and the rotation amount of the vehicle end-side end part of the link lever relative to the rotation amount of the intermediate part of the link lever can be changed. As a result, the slip angles of the pair of running wheels can be changed. Therefore, by changing the ratio of the distance between the vehicle end-side end part of the link lever and the center-side end part, to the distance between the support shaft in the intermediate part of the link lever and the center-side end part based on the curvature radius of the curved guide rail, the running speed of the vehicle or the like, the slip angles of the pair of running wheels can be appropriately adjusted so as to effectively decrease the contact pressure of the guide wheel and the guide rail. For example, when the running wheel is a rubber tire, the distance between the vehicle end-side end part of the link lever and the center-side end part is increased relative to the distance between the support shaft in the intermediate part of the link lever and the center-side end part in response to the decrease in the cornering force due to the wear of the rubber tire. Accordingly, the slip angles of the pair of running wheels can be increased, and the contact pressure of the guide wheel and the guide rail can be adjusted so as to be decreased.

Therefore, while the structure of the track-guided vehicle wheel truck is simplified, the wear and deterioration of the guide wheel and the guide rail can be effectively prevented, and the running stability of the vehicle can be also ensured.

In the track-guided vehicle wheel truck according to the present invention, a restoration mechanism capable of restoring the support shaft to an original position, after moving the support shaft, is provided in the guide frame, and the support shaft is movable by an actuator provided in the guide frame. Therefore, the relationship between the control of the ratio of the distance between the vehicle end-side end part of the link lever and the center-side end part to the distance between the support shaft in the intermediate part of the link lever and the center-side end part by the actuator, and the adjustment of the slip angles of the pair of running wheels, is simplified. Therefore, the control of the track-guided vehicle wheel truck can be simplified. Furthermore, even when the actuator is broken, the restoration mechanism can restore the support shaft to the original neutral position before being moved by the actuator. In addition, the operation of the actuator is separated from the turning of the guide frame and the steering of the running wheel. Therefore, even when the actuator is broken, the pair of running wheels is normally steered corresponding to straight running and curve running, so that the vehicle can normally run. Accordingly, the occurrence of trouble in association with the breakdown of the actuator can be prevented, and the vehicle running stability can be also ensured.

In the track-guided vehicle wheel truck according to the present invention, the support shaft is movable in the vehicle width direction by an actuator. Therefore, since the support shaft is controlled by the actuator, the movement of the connecting rod in the vehicle width direction in association with the rotation of the link lever can be controlled without being affected by the turning of the guide frame. As a result, the steering of the pair of running wheels is directly controlled, and the fine adjustment thereof is enabled. In the vehicle that is running straight, the slip angle of the running wheel is finely adjusted in response to a disturbance such as crosswind, so that the running stability can be ensured.

In the track-guided vehicle wheel truck according to the present invention, the guide wheel is supported by a leaf spring provided in the guide frame, detecting means for detecting a displacement of the leaf spring is provided, and control means for controlling the actuator corresponding to the displacement of the leaf spring detected by the detecting means, is provided. Therefore, even when a disturbance such as an impact is applied to the guide wheel from the guide rail, the disturbance transmitted to the guide frame is mitigated by the leaf spring, so that the vehicle running stability can be ensured. The vehicle gives a passenger a more comfortable ride. In addition, the steering amount of the pair of running wheels can be quickly controlled by the actuator corresponding to the displacement of the guide wheel relative to the guide frame detected by the detecting means. Therefore, when the vehicle runs on the curved guide rail, the slip angles of the pair of running wheels can be quickly and appropriately adjusted. The vehicle running stability can thereby be ensured.

DESCRIPTION OF EMBODIMENTS

In the following, wheel trucks used for a track-guided vehicle (hereinafter referred to as a "vehicle") according to first to fourth embodiments of the present invention, will be described. The first to fourth embodiments of the present invention will be described by employing, as one example of the vehicle, a vehicle provided with wheel trucks on the front side and the rear side thereof, and the description will be made taking the vehicle travel direction as the vehicle front.

First Embodiment

Figure 1:
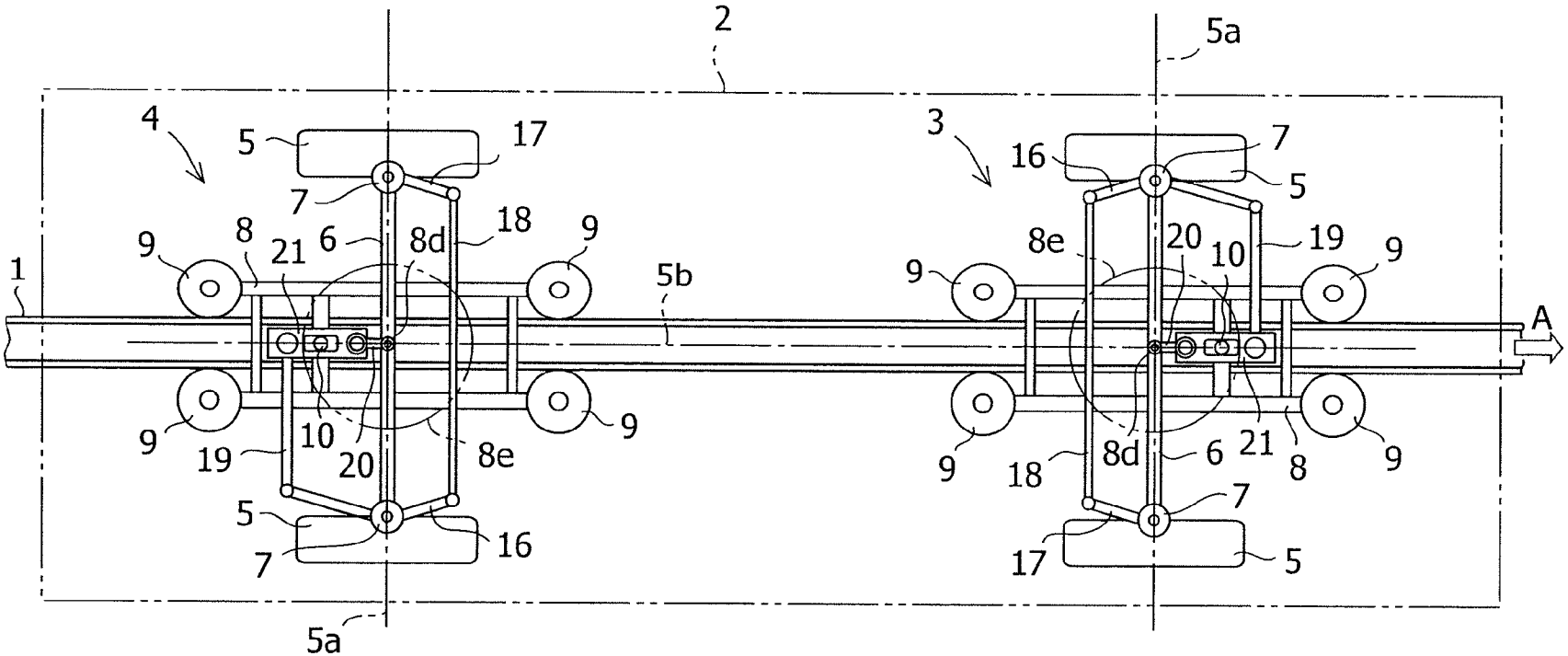
FIG. 1 is an explanatory view schematically illustrating a track-guided vehicle that is running straight according to a first embodiment of the present invention.

A vehicle wheel truck, according to the first embodiment of the present invention, will be described below. Referring to FIG. 1, in a vehicle traveling in the direction indicated by the arrow A, center guides 1 in the vehicle width direction are arranged along a track path of the vehicle in the middle of the vehicle width direction of the vehicle. The vehicle runs while being guided along the center guide 1. In the vehicle as described above, a front wheel truck 3 and a rear wheel truck 4 are respectively arranged on the front side and the rear side under a vehicle body 2.

The structures of the front wheel truck 3 and the rear wheel truck 4 (hereinafter referred to as "wheel trucks 3 and 4"), will now be described by reference to FIGS. 1 to 3. In the wheel trucks 3 and 4, a pair of running wheels 5 is provided. As one example of the running wheel 5, a rubber tire is used mainly in a vehicle such as a subway car and a new transportation system vehicle. As another example of the running wheel 5, a wheel made of any other material, such as a steel wheel, may be used. The aforementioned pair of running wheels 5 can rotate around an identical axis 5*a*, and is arranged at an interval in the vehicle width direction. In the wheel trucks 3 and 4, a steering axle 6 is arranged along the axis 5*a* of the running wheel 5. The two running wheels 5 are respectively mounted to the two end parts of the steering axle 6 by kingpin 7, and they are thereby connected to each other. On the other hand, a guide frame 8 is arranged below the steering axle 6 so as to extend in the vehicle front and rear direction relative to the steering axle 6.

Figure 2:
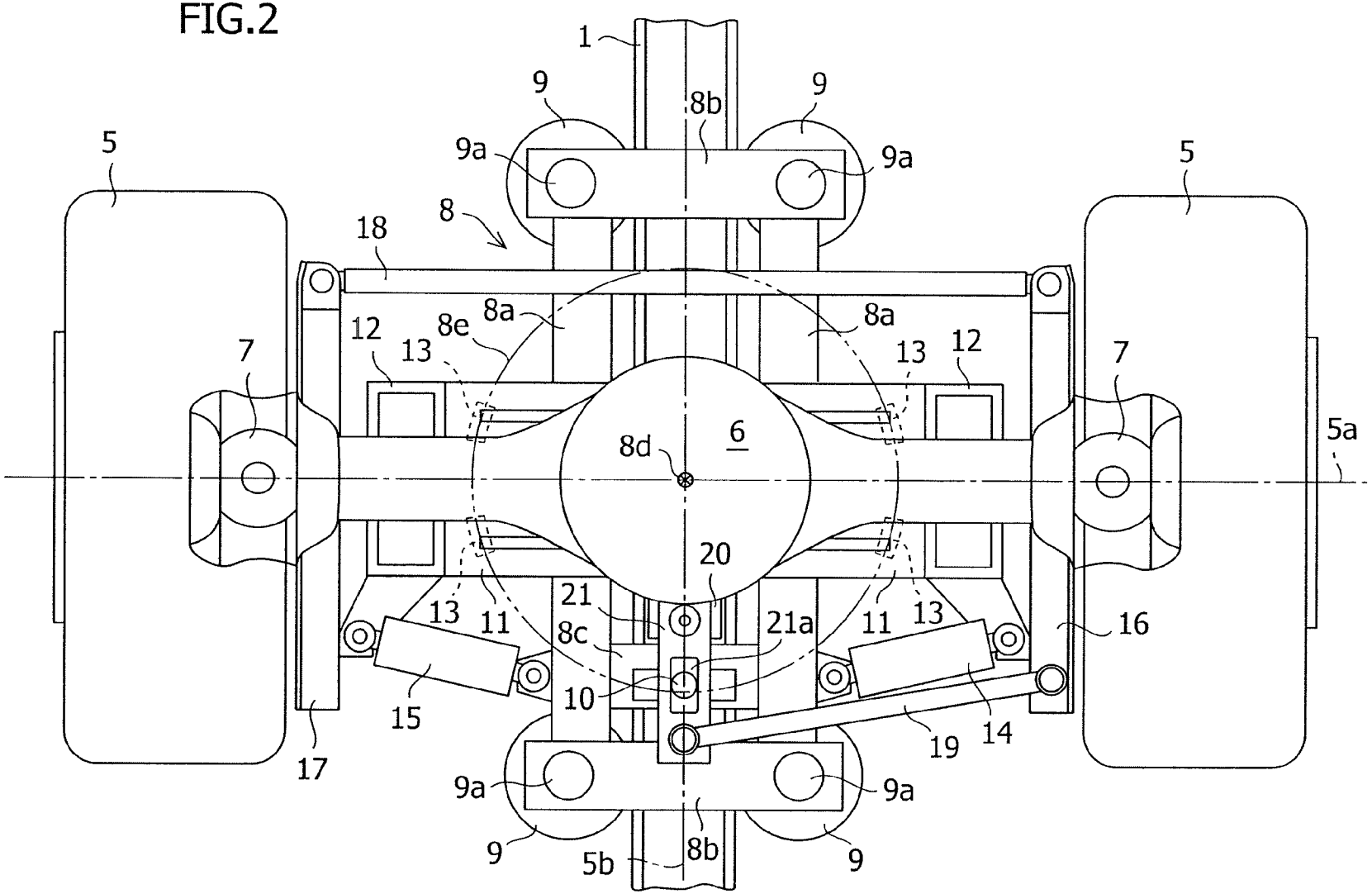
FIG. 2 is a plan view schematically illustrating a track-guided vehicle wheel truck according to the first embodiment of the present invention.
Figure 3:
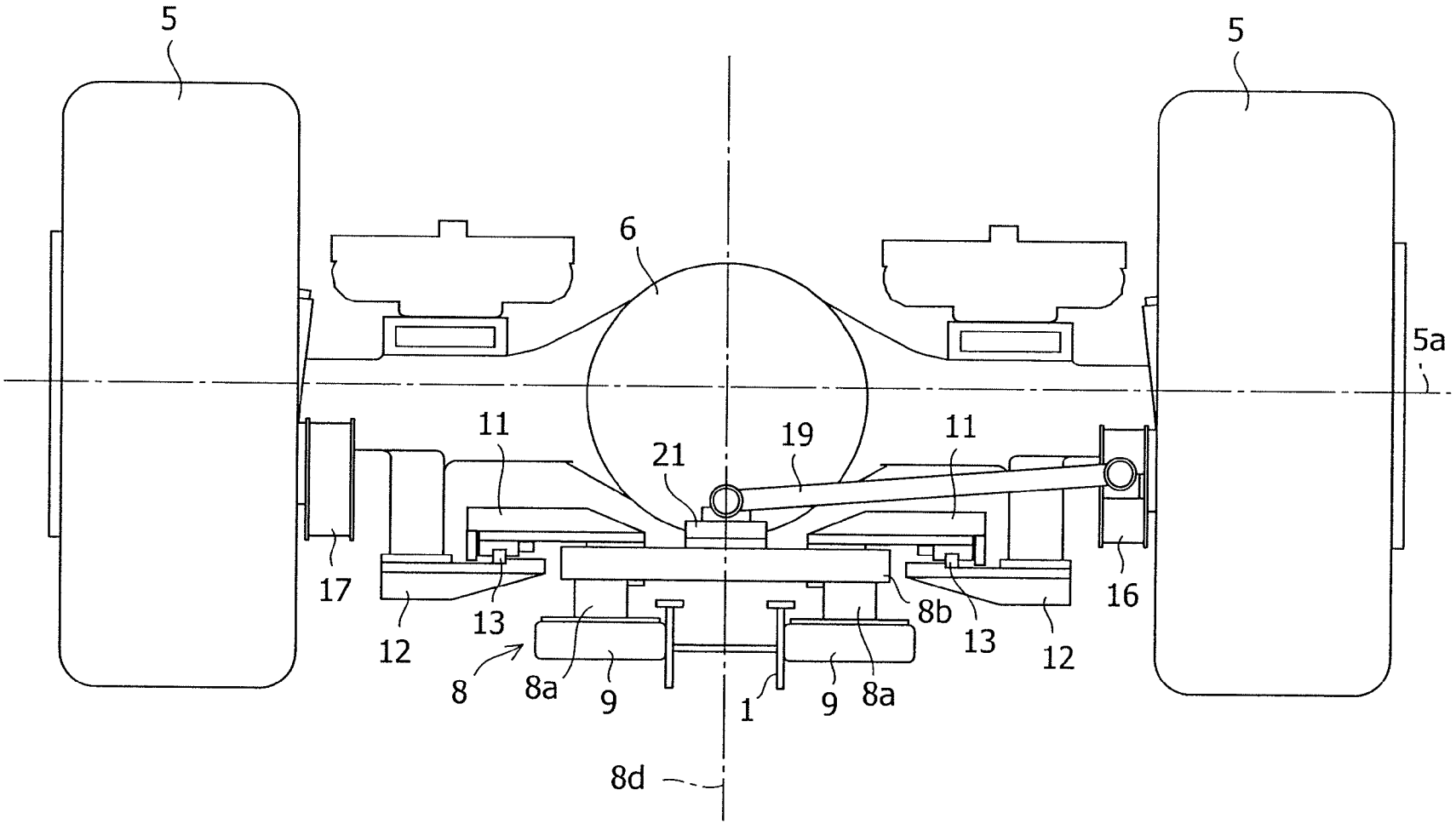
FIG. 3 is a front view schematically illustrating the track-guided vehicle wheel truck according to the first embodiment of the present invention.

Here, referring to FIGS. 2 and 3, in the guide frame 8, a pair of longitudinal beams 8*a* is arranged at an interval in the vehicle width direction so as to extend in the vehicle front and rear direction. Lateral beams 8*b* are further arranged so as to respectively extend between the pair of longitudinal beams 8*a* at the two end parts of the vehicle front and rear direction thereof. Guide wheels 9 are mounted to the two end parts of the longitudinal beam 8*a* so as to be rotatable around a rotation shaft 9*a*. Therefore, the paired guide wheels 9 are positioned on each of the vehicle end side and the center side of the vehicle front and rear direction relative to the steering axle 6. The center guide 1 passes between the pair of guide wheels 9. The guide wheel 9 rolls along the outer surface of the vehicle width direction of the center guide 1, and is thereby guided by the center guide 1.

In the guide frame 8, a support beam 8*c* is arranged at a position between the steering axle 6 and the lateral beam 8*b* on the vehicle end side so as to extend between the pair of longitudinal beams 8*a*. A support shaft 10 is provided on the support beam 8*c*. The support shaft 10 is arranged on a center axis 5*b* which extends in the vehicle front and rear direction in the center of the pair of running wheels 5, and is mounted to the support beam 8*c* such that its position can be adjusted in the vehicle front and rear direction.

In the guide frame 8, a first turn member 11 is arranged along the steering axle 6 so as to extend outward in the vehicle width direction from each of the pair of longitudinal beams 8*a*. A second turn member 12 is arranged below the first turn member 11 so as to extend in the vehicle width direction. A linear guide 13 is provided between the first turn member 11 and the second turn member 12. The linear guide 13 is arranged on a virtual circle 8*e* having a given radius from a turning center shaft 8*d* which extends vertically in the center of the pair of running wheels 5. The turning center shaft 8*d* corresponds to the intersection between the axis 5*a* of the running wheel 5 and the center axis 5*b* extending in the vehicle front and rear direction in the center of the pair of running wheels 5. The linear guide 13 allows the first turn member 11 to be turned around the turning center shaft 8*d* relative to the second turn member 12. The second turn member 12 is mounted to the steering axle 6. Therefore, the guide frame 8 can be turned around the turning center shaft 8*d* relative to the steering axle 6.

As shown in FIG. 2, in the wheel trucks 3 and 4, a restoration rod 14 and a horizontal damper 15 are provided. In FIG. 3, the restoration rod 14 and the horizontal damper 15 are omitted. The restoration rod 14 is arranged on the vehicle end side relative to the steering axle 6 and on one side of the pair of running wheels 5 relative to the center axis 5*b*. One end part of the restoration rod 14 is rotatably mounted to the longitudinal beam 8*a* of the guide frame 8, and the other end part of the restoration rod 14 is rotatably mounted to the second turn member 12. On the other hand, the horizontal damper 15 is arranged on the vehicle end side relative to the steering axle 6 and on the other side of the pair of running wheels 5 relative to the center axis 5*b*. One end part of the horizontal damper 15 is rotatably mounted to the longitudinal beam 8*a* of the guide frame 8, and the other end part of the horizontal damper 15 is rotatably mounted to the second turn member 12. Accordingly, the restoration rod 14 and the horizontal damper 15 can restore the guide frame 8 to an original neutral position after being turned and further buffer the turning of the guide frame 8.

Here, referring to FIGS. 1 and 2 again, a first steering arm 16 for enabling steering of one of the pair of running wheels 5, is arranged along the vehicle front and rear direction, and is also mounted to one of the kingpins 7 of the pair of running wheels 5. A second steering arm 17 for enabling steering of the other of the pair of running wheels 5, is arranged along the vehicle front and rear direction, and also mounted to the other of the kingpins 7 of the pair of running wheels 5. A tie rod 18 for interlocking the pair of running wheels 5 with each other is arranged along the vehicle width direction on the center side of the steering axle 6. The two end parts of the tie rod 18 are rotatably mounted respectively to center-side end parts of the first steering aim 16 and the second steering arm 17. A connecting rod 19 for steering one of the pair of running wheels 5, is arranged along the vehicle width direction on the vehicle end side of the steering axle 6. A receiving member 20 is arranged in a center part of the vehicle width direction of the steering axle 6 so as to project toward the vehicle end side. In the wheel trucks 3 and 4, a link lever 21 is arranged along the center axis.

A vehicle end-side end part of the first steering lever 16 is rotatably mounted to one end part of the connecting rod 19. A vehicle end-side end part of the link lever 21 is rotatably mounted to the other end part of the connecting rod 19. A center-side end part of the link lever 21 is rotatably mounted to the receiving member 20 provided on the steering axle 6. A long hole 21*a* is provided in an intermediate part of the link lever 21 so as to extend in the vehicle front and rear direction. The long hole 21*a* and the support shaft 10 provided on the guide frame 8, are rotatably engaged with each other at a given position. The engagement position of the support shaft 10 and the long hole 21*a*, can be thereby changed in the vehicle front and rear direction.

Figure 4:
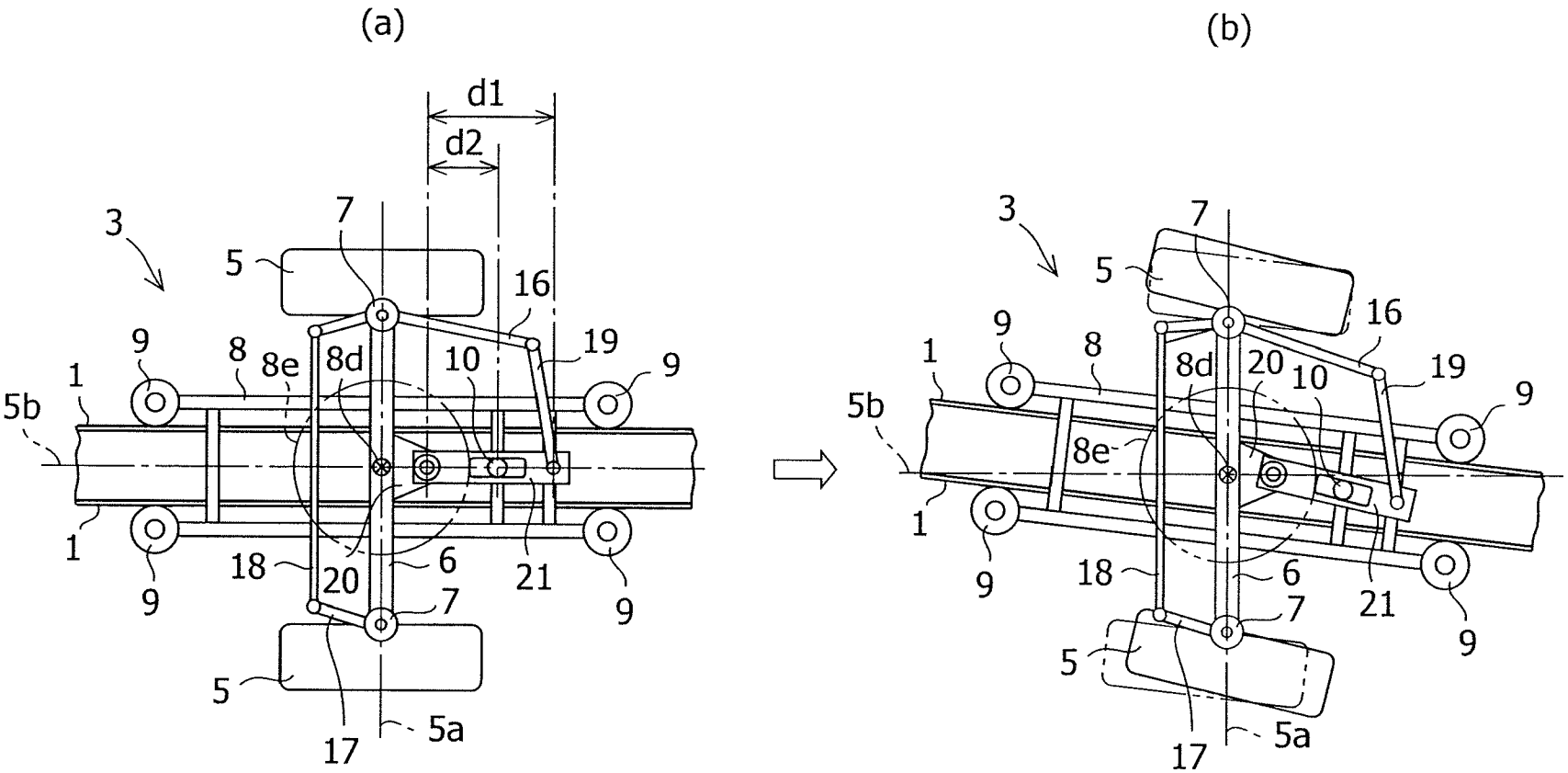
FIG. 4(*a*) is an explanatory view schematically illustrating a track-guided vehicle wheel truck on the vehicle front side during straight running, and FIG. 4(*b*) is an explanatory view schematically illustrating a track-guided vehicle wheel truck on the vehicle front side during curve running.

The operation during curve running will now be described with reference to FIGS. 4(*a*), 4(*b*), and 5. Since the support shaft 10 of the guide frame 8 and the intermediate part of the link lever 21, are engaged with each other and the center-side end part of the link lever 21, is mounted to the receiving member 20 on the vehicle end side relative to the steering axle 6, the link lever 21 rotates around the center-side end part when the vehicle moves into the curved side guide 1, and the guide frame 8 and the guide wheel 9 are turned along the curved center guide 1. At this time, the vehicle end-side end part of the link lever 21, rotates in a larger circle than the intermediate part of the link lever 21 corresponding to the ratio of a distance d1 (shown in FIG. 4(*a*)) between the vehicle end-side end part of the link lever 21 and the center-side end part, to a distance d2 (shown in FIG. 4(*a*)) between the support shaft 10 in the intermediate part of the link lever 21 and the center-side end part. Therefore, the vehicle end-side end part of the link lever 21 is moved more than the guide frame 8 in the same direction as the turning of the guide frame 8. The connecting rod 19 is thereby moved, so that the first steering arm 16 is also moved. As a result, one of the pair of running wheels 5 is steered. In this case, a slip angle $\alpha 1$ tilting to the curve inside relative to the tangential direction of the curve is generated in one of the pair of running wheels 5 in the front wheel truck 3, and a slip angle $\alpha 2$ tilting to the curve outside relative to the tangential direction of the curve is generated in one of the pair of running wheels 5 in the rear wheel truck 4. When one of the pair of running wheels 5 is steered, the tie rod 18 is moved, so that the second steering arm 17 is also moved. As a result, the other of the pair of running wheels 5 is steered. In this case, a slip angle $\alpha 1$ tilting to the curve inside relative to the tangential direction of the curve is generated in the other of the pair of running wheels 5 in the front wheel truck 3, and a slip angle $\alpha 2$ tilting to the curve outside relative to the tangential direction of the curve is generated in the other of the pair of running wheels 5 in the rear wheel truck 4. Therefore, the wheel trucks 3 and 4 are brought into an oversteer state.

Figure 5:
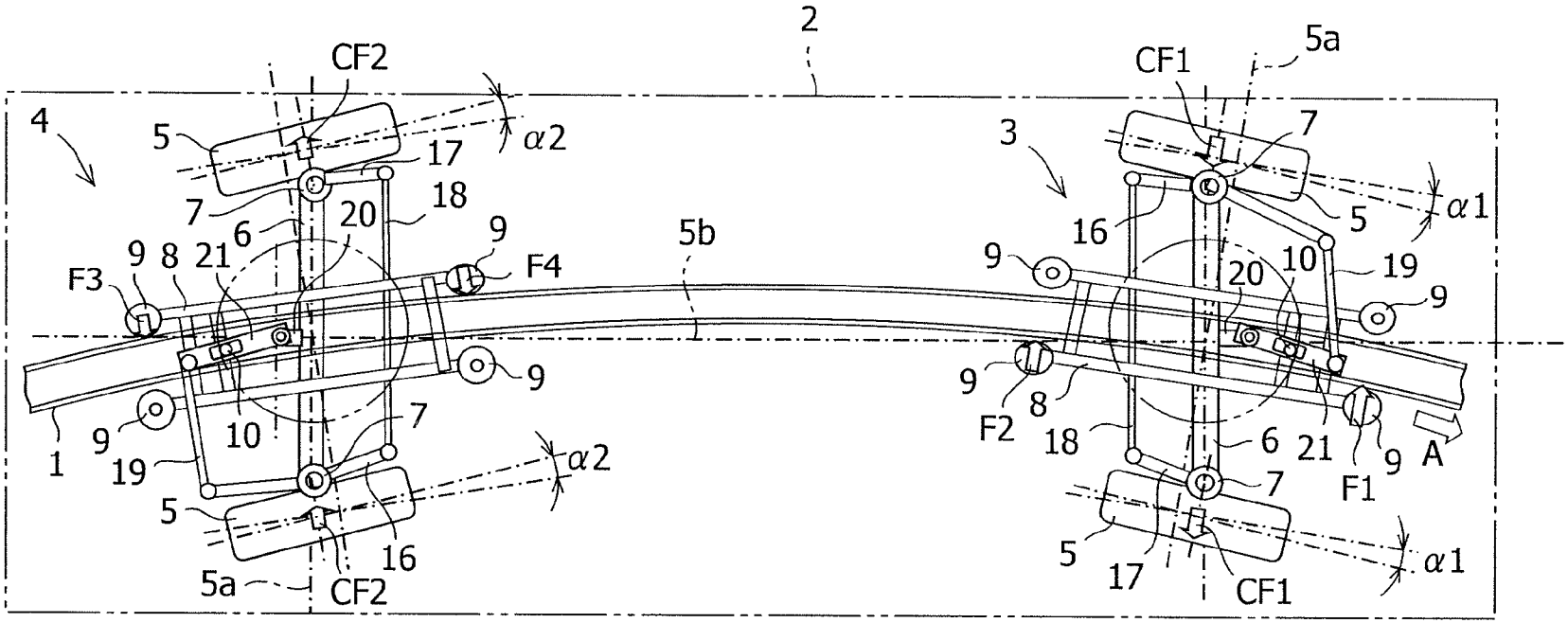
FIG. 5 is an explanatory view schematically illustrating a track-guided vehicle that is running on a curve according to the first embodiment of the present invention.

At this time, as shown in FIG. 5, in the front wheel truck 3, a cornering force (indicated by the arrow CF1) directed toward the inside of the curve, is increased on the pair of running wheels 5, so that on the curve inside, a guide wheel working force (indicated by the arrow F1) from the guide wheel 9 on the vehicle end side and a guide wheel working force (indicated by the arrow F2) from the guide wheel 9 on the center side can be decreased. Accordingly, the contact pressure of the center guide 1 and the guide wheels 9 on the curve inside can be decreased. On the other hand, in the rear wheel truck 4, a cornering force (indicated by the arrow CF2) directed toward the outside of the curve is increased on the pair of running wheels 5, so that on the curve outside, a guide wheel working force (indicated by the arrow F3) from the guide wheel 9 on the vehicle end side and a guide wheel working force (indicated by the arrow F4) from the guide wheel 9 on the center side, can be decreased. Accordingly, the contact pressure of the center guide 1 and the guide wheels 9 on the curve outside can be decreased.

Furthermore, the adjustment of the steering amount of the running wheel 5 relative to the turning amount of the guide frame 8 will be described with reference to FIGS. 4(*a*), 4(*b*), and 5. Since the support shaft 10 is provided on the guide frame 8 such that its position can be adjusted in the vehicle front and rear direction, the engagement position of the support shaft 10 and the long hole 21*a,* can be changed in the intermediate part of the link lever 21. Therefore, the ratio of the distance d1 between the vehicle end-side end part of the link lever 21 and the center-side end part, to the distance d2 between the support shaft 10 in the intermediate part of the link lever 21 and the center-side end part, can be changed, and the rotation amount of the vehicle end-side end part of the link lever 21 relative to the rotation amount of the intermediate part of the link lever 21, can be changed. As a result, the slip angles $\alpha 1$ and $\alpha 2$ of the pair of running wheels 5 can be changed.

As described above, according to the first embodiment of the present invention, by changing the ratio of the distance d1 between the vehicle end-side end part of the link lever 21 and the center-side end part, to the distance d2 between the support shaft 10 in the intermediate part of the link lever 21 and the center-side end part based on the curvature radius of the curved center guide 1, the running speed of the vehicle or the like, the slip angles $\alpha 1$ and $\alpha 2$ of the pair of running wheels 5, can be appropriately adjusted so as to effectively decrease the contact pressure of the center guide 1 and the guide wheels 9. For example, when the running wheel 5 is a rubber tire, the distance d1 between the vehicle end-side end part of the link lever 21 and the center-side end part is increased relative to the distance d2 between the support shaft 10 in the intermediate part of the link lever 21 and the center-side end part in response to the decrease in the cornering force due to the wear of the rubber tire. Accordingly, the slip angles $\alpha 1$ and $\alpha 2$ of the pair of running wheels 5 can be increased, and the contact pressure of the center guide 1 and the guide wheels 9 can be adjusted so as to be decreased.

As described above, while the structures of the wheel trucks 3 and 4 are simplified, the wear and deterioration of the center guide 1 and the guide wheels 9 can be effectively prevented, and the running stability of the vehicle can be also ensured.

Second Embodiment

Vehicle wheel trucks according to the second embodiment of the present invention will be described below. The basic features of the vehicle in the second embodiment are the same as those of the vehicle in the first embodiment. The description is given applying the same symbols and names as those in the first embodiment to elements that are essentially the same as those in the first embodiment. Features different from those in the first embodiment will be described below.

Figure 6:
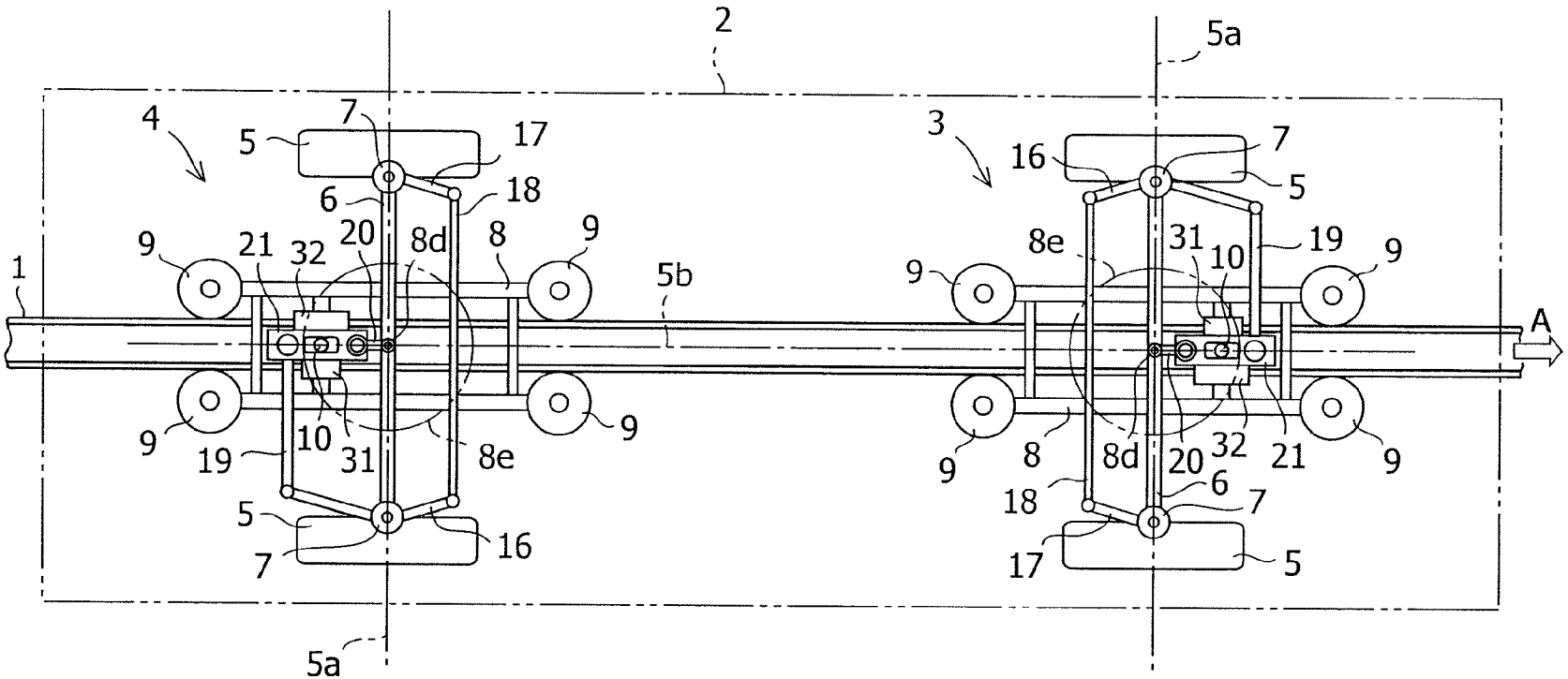
FIG. 6 is an explanatory view schematically illustrating a track-guided vehicle that is running straight according to a second embodiment of the present invention.

As shown in FIG. 6, a restoration mechanism 31 is arranged along the vehicle front and rear direction in the guide frame 8. The restoration mechanism 31 is provided so as to restore the support shaft 10 to an original neutral position in a straight running state when the support shaft 10 is moved during curve running or the like. As one example of the restoration mechanism 31, a coil spring may be used. Any urging means other than the coil spring may be also used. In the guide frame 8, an actuator 32 which is extensible and retractable in the vehicle front and rear direction is arranged along the vehicle front and rear direction. The actuator 32 can move the support shaft 10 in the vehicle front and rear direction. Accordingly, the position of the support shaft 10 in the vehicle front and rear direction can be adjusted by the operation of the actuator 32.

As described above, according to the second embodiment of the present invention, the relationship between the control of the ratio of the distance d1 between the vehicle end-side end part of the link lever 21 and the center-side end part to the distance d2 between the support shaft 10 in the intermediate part of the link lever 21 and the center-side end part by the actuator 32, and the adjustment of the slip angles $\alpha 1$ and $\alpha 2$ of the pair of running wheels 5, is simplified. Therefore, the control of the wheel trucks 3 and 4 can be simplified. Even when the actuator 32 is broken, the restoration mechanism 31 can restore the support shaft 10 to the original neutral position before being moved by the actuator 32. Therefore, the operation of the actuator 32 is also separated from the turning of the guide frame 8 and the steering of the running wheel 5. Therefore, even when the actuator 32 is broken, the two running wheels 5 are normally steered corresponding to straight running and curve running, so that the vehicle can normally run. Accordingly, the occurrence of trouble in association with the breakdown of the actuator 32, can be prevented, and the vehicle running stability can be thereby ensured.

Third Embodiment

Vehicle wheel trucks according to the third embodiment of the present invention will be described below. The basic features of the vehicle in the third embodiment are the same as those of the vehicle in the first embodiment. The description is given applying the same symbols and names as those in the first embodiment to elements that are essentially the same as those in the first embodiment. Features different from those in the first embodiment will be described below.

Figure 7:
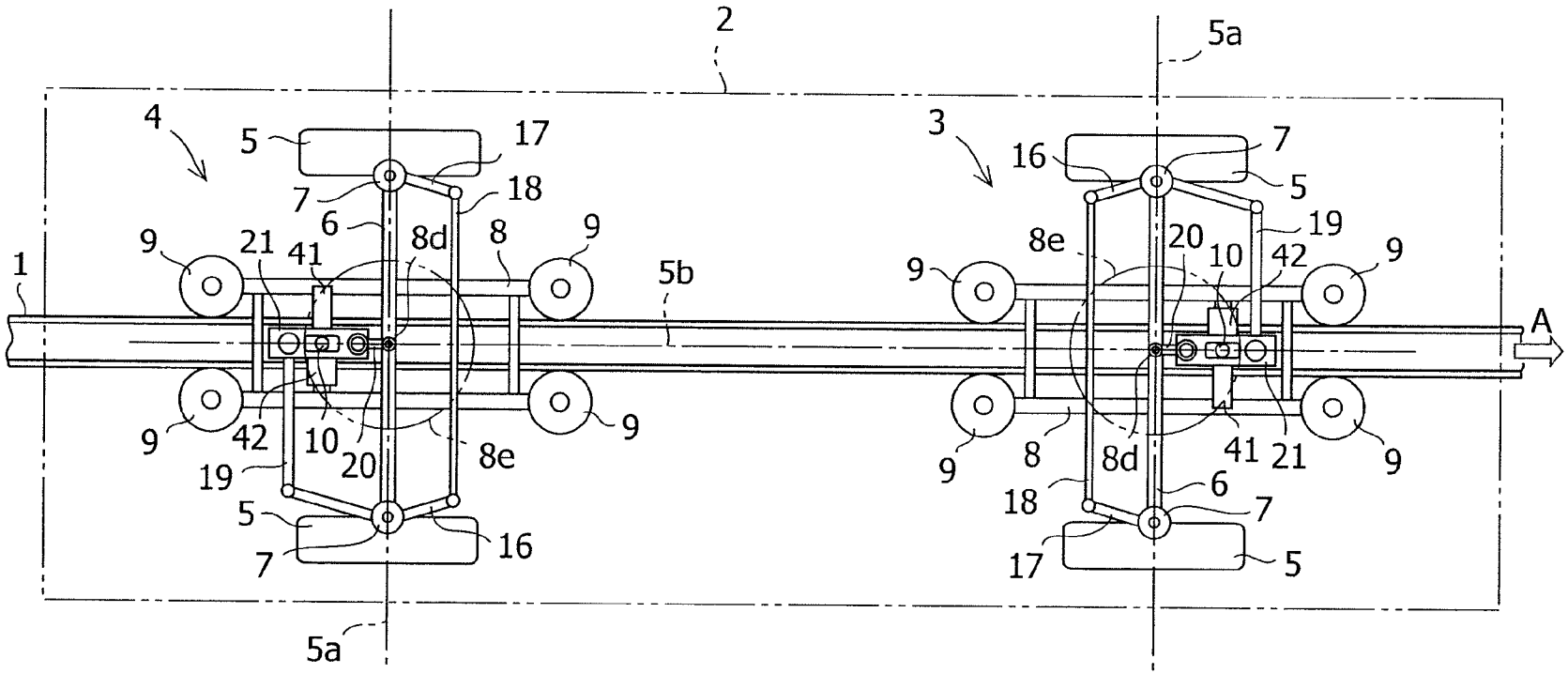
FIG. 7 is an explanatory view schematically illustrating a track-guided vehicle that is running straight according to a third embodiment of the present invention.

As shown in FIG. 7, the support shaft 10 is movable in the vehicle width direction relative to the guide frame 8, and in the guide frame 8, an actuator 41 which is extensible and retractable in the vehicle width direction is arranged along the vehicle width direction. The actuator 41 can move the support shaft 10 in the vehicle width direction. Accordingly, the position of the support shaft 10 in the vehicle width direction can be adjusted by the operation of the actuator 41. In the guide frame 8, a restoration mechanism 42 is arranged along the vehicle width direction. The restoration mechanism 42 is provided so as to restore the support shaft 10 to an original neutral position in a straight running state when the support shaft 10 is moved by the actuator 41. As one example of the restoration mechanism 42, a coil spring may be used. Any urging means other than the coil spring may be also used.

As described above, according to the third embodiment of the present invention, since the support shaft 10 is controlled by the actuator 41, the movement of the connecting rod 19 in the vehicle width direction in association with the rotation of the link lever 21 can be controlled without being affected by the turning of the guide frame 8. As a result, the steering of the pair of running wheels 5 is directly controlled, and the fine adjustment thereof is enabled. Accordingly, in the vehicle that is running straight, the slip angle of the running wheel 5 is finely adjusted in response to a disturbance such as crosswind, so that the running stability can be ensured. Even when the actuator 41 is broken, the restoration mechanism 42 can restore the support shaft 10 to the original neutral position before being moved. Therefore, even when the actuator 41 is broken, the same control as that in the first embodiment can be performed, and the vehicle can normally run.

Fourth Embodiment

Vehicle wheel trucks according to the fourth embodiment of the present invention will be described below. The basic features of the vehicle in the fourth embodiment are the same as those of the vehicle in the third embodiment. The description is given applying the same symbols and names as those in the third embodiment to elements that are essentially the same as those in the third embodiment. Features different from those in the third embodiment will be described below.

Figure 8:
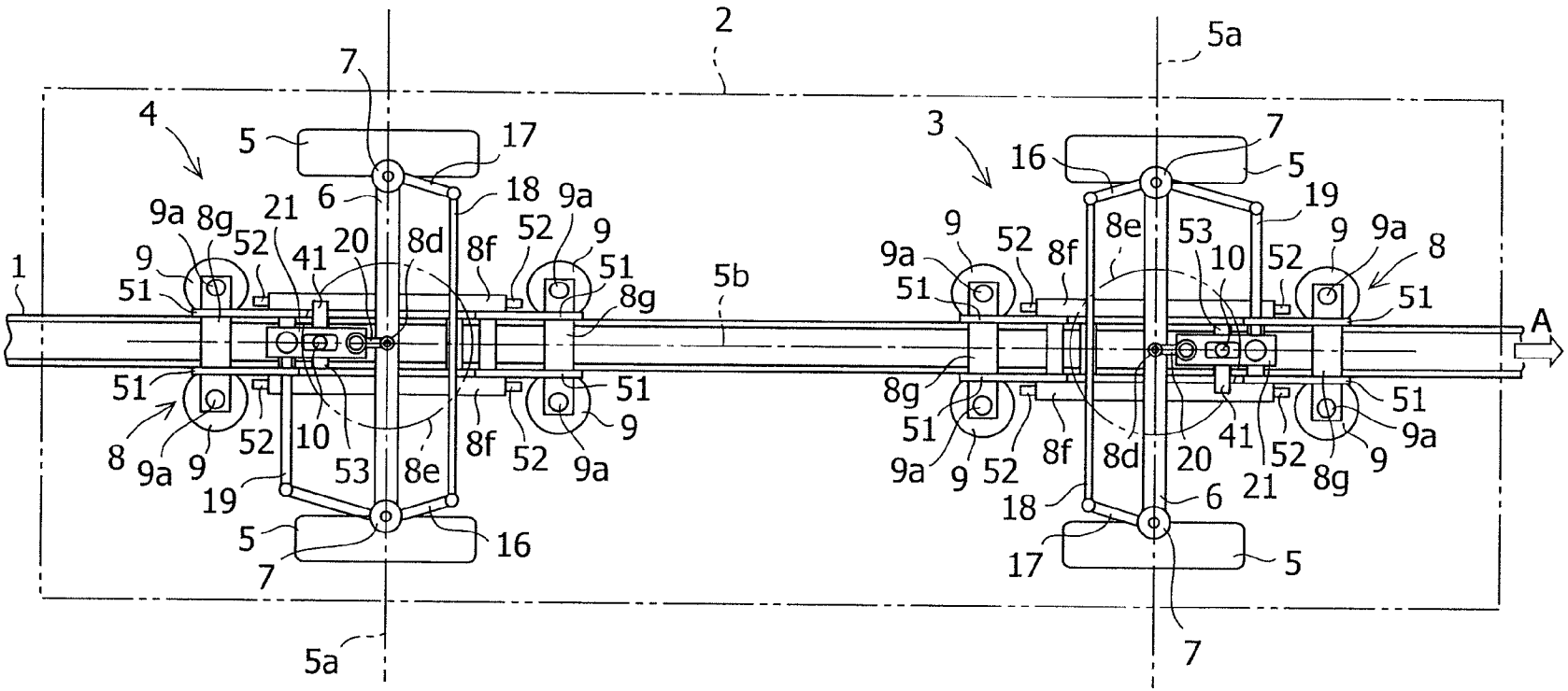
FIG. 8 is an explanatory view schematically illustrating a track-guided vehicle that is running straight according to a fourth embodiment of the present invention.

As shown in FIG. 8, in the guide frame 8, a pair of longitudinal beams 8*f* is arranged at an interval in the vehicle width direction so as to extend in the vehicle front and rear direction. Lateral beams 8*g* are arranged so as to respectively extend in the vehicle width direction at the two end parts of the vehicle front and rear direction of the guide frame 8. The guide wheels 9 are mounted to the two end parts of the lateral beam 8*g* so as to be rotatable around the rotation shaft 9*a*. Leaf springs 51 are arranged between the longitudinal beams 8*f* and the lateral beams 8*g* at the the two end parts of the vehicle front and rear direction. Therefore, the paired guide wheels 9 and the paired leaf springs 51 are positioned on each of the vehicle end side and the center side of the vehicle front and rear direction relative to the steering axle 6. The center guide 1 passes between the pair of guide wheels 9. The guide wheel 9 rolls on the outer surface of the vehicle width direction of the center guide 1, and is thereby guided by the center guide 1.

Detecting means 52, capable of detecting the displacement of the leaf spring 51, is provided in the guide frame 8 corresponding to the leaf spring 51. As one example of the detecting means 52, a limit switch may be employed. Another detecting means may be also employed as long as the means can detect the displacement of the leaf spring 51. Control means 53 for controlling the actuator 41 corresponding to the displacement of the leaf spring 51 detected by the detecting means 52, is also provided.

As described above, according to the fourth embodiment of the present invention, even when a disturbance such as an impact is applied to the guide wheel 9 from the center guide 1, the disturbance transmitted to the guide frame 8 is mitigated by the leaf spring 51, so that the vehicle running stability can be ensured. The vehicle gives a passenger a more comfortable ride. Furthermore, the steering amount of the pair of running wheels 5 can be quickly controlled by the actuator 41 corresponding to the displacement of the guide wheel 9 relative to the guide frame 8 detected by the detecting means 52. Therefore, when the vehicle runs on the curved center guide 1, the slip angles of the pair of running wheels 5 can be quickly and appropriately adjusted. The vehicle running stability can be thereby ensured.

Embodiments of the present invention have been described above. It should be noted that the present invention is not limited to the above described embodiments, and various modifications and changes may be made therein based on the technical concepts of the present invention.

For example, as a first modification of the embodiment, in the first to fourth embodiments, the guide wheels 9 may be guided by rolling on the inner surfaces of the vehicle width direction of a pair of right and left guide rails in the vehicle width direction, which is of center guide type. The same effects as those in the first to fourth embodiments can be thereby obtained.

As a second modification of the embodiment of the present invention, in the first to fourth embodiments, the guide wheels 9 may be guided by a pair of right and left side guides arranged on the outer side of the vehicle width direction of the vehicle. The same effects as those in the first to fourth embodiments can be thereby obtained.

As a third modification of the embodiment of the present invention, the guide frame 8, the leaf spring 51, the detecting means 52 and the control means 53 provided as in the fourth embodiment may be applied to the wheel trucks 3 and 4 in the second embodiment. The same effects as those in the fourth embodiment can be thereby obtained.

REFERENCE SIGNS LIST

1 Center guide
2 Vehicle body
3 Front wheel truck
4 Rear wheel truck
5 Running wheel
5*a* Axis
5*b* Center axis
6 Steering axle
7 Kingpin
8 Guide frame
8*a*, 8*f* Longitudinal beam
8*b*, 8*g* Lateral beam
8*c* Support beam
8*d* Turning center shaft
8*e* Virtual circle
9 Guide wheel
10 Support shaft
11 First turn member
12 Second turn member
13 Linear guide
14 Restoration rod
15 Horizontal damper
16 First steering arm
17 Second steering arm
18 Tie rod
19 Connecting rod
20 Receiving member
21 Link lever
21*a* Long hole
31 Restoration mechanism
32 Actuator
41 Actuator
51 Leaf spring
52 Detecting means
53 Control means
A, F1 to F4, CF1 to CF2, S Arrow
$\alpha$1, $\alpha$2 Slip angle
d1, d2 Distance

The invention claimed is:

1. A track-guided vehicle wheel truck including:

a pair of running wheels respectively connected to the two ends of a steering axle by a kingpin;

a guide wheel guided along a guide provided on a running track; and a guide frame to which the guide wheel is mounted, the guide frame capable of being turned relative to the steering axle, the track-guided vehicle wheel truck comprising:

a tie rod arranged along a vehicle width direction on a center side of a vehicle front and rear direction relative to the steering axle, and capable of interlocking the pair of running wheels with each other;

a connecting rod arranged on a vehicle end side of the vehicle front and rear direction relative to the steering axle, and capable of steering one of the pair of running wheels;

a first steering arm arranged along the vehicle front and rear direction, and mounted to one of the kingpins of the pair of running wheels;

a second steering arm arranged along the vehicle front and rear direction, and mounted to the other of the kingpins of the pair of running wheels;

a support shaft provided on the guide frame such that its position can be adjusted in the vehicle front and rear direction; and a link lever arranged along the vehicle front and rear direction;

wherein the two end parts of the tie rod are rotatably mounted respectively to center-side end parts of the first steering arm and the second steering arm;

wherein the two end parts of the connecting rod are rotatably mounted respectively to a vehicle end-side end part of the first steering arm and a vehicle end-side end part of the link lever;

wherein a center-side end part of the link lever is rotatably mounted to a receiving member provided projecting toward the vehicle end side in a center part of the vehicle width direction of the steering axle;

wherein a long hole is provided in an intermediate part of the link lever so as to extend in the vehicle front and rear direction; and wherein the long hole and the support shaft are rotatably engaged with each other at a given position.

2. A track-guided vehicle wheel truck according to claim 1, wherein a restoration mechanism capable of restoring the support shaft to an original position after moving the support shaft, is provided in the guide frame, and the support shaft is movable by an actuator provided in the guide frame.

3. A track-guided vehicle wheel truck according to claim 1, wherein the support shaft is movable in the vehicle width direction by an actuator.

4. A track-guided vehicle wheel truck according to claim 3, wherein the guide wheel is supported by a leaf spring provided in the guide frame, detecting means for detecting a displacement of the leaf spring is provided, and control means for controlling the actuator corresponding to the displacement of the leaf spring detected by the detecting means is provided.

* * * * *